United States Patent [19]

Koenig

[11] 4,168,978

[45] Sep. 25, 1979

[54] TRANSFER FOIL

[75] Inventor: Claus Koenig, Erlangen, Fed. Rep. of Germany

[73] Assignee: Claus Koenig K.G., Fed. Rep. of Germany

[21] Appl. No.: 854,246

[22] Filed: Nov. 23, 1977

[30] Foreign Application Priority Data

Nov. 24, 1976 [DE] Fed. Rep. of Germany ..... 2653428

[51] Int. Cl.[2] ..... G03C 1/76

[52] U.S. Cl. ..... 96/68; 96/33; 96/75; 428/40; 428/199; 428/913

[58] Field of Search ..... 96/85, 87 R, 33, 68, 96/75; 427/53, 54, 147, 148; 428/40, 199, 913, 201-204, 211

[56] References Cited

U.S. PATENT DOCUMENTS

| | | | |
|---|---|---|---|
| 3,046,120 | 7/1962 | Schmidt et al. | 96/91 D |
| 3,326,682 | 6/1967 | Endermann et al. | 96/91D |
| 3,754,920 | 8/1973 | Kuchta | 96/87 R |
| 3,933,503 | 1/1976 | Schönberg | 96/85 |

FOREIGN PATENT DOCUMENTS 865860 2/1953 Fed. Rep. of Germany .

*Primary Examiner*—George F. Lesmes
*Assistant Examiner*—Bruce H. Hess
*Attorney, Agent, or Firm*—Schuyler, Birch, Swindler, McKie and Beckett

[57] ABSTRACT

Composite foils for producing colored advertising indicia comprise a colored, tacky layer between two release foils, the colored layer being sensitive to light either as being solubilized in exposed areas, these areas being washed away to leave the indicia, or as being insolubilized by exposure, the unexposed areas being washed away.

3 Claims, 1 Drawing Figure

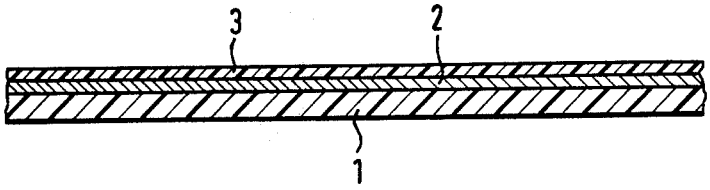
3
2
1

TRANSFER FOIL

The invention relates to a coloured multilayer foil for producing a pattern for advertising purposes, consisting of a light-sensitive coloured layer sandwiched between protective foils.

A coloured foil having an aluminium foil as support is known from German Patent Specification No. 865 860. This coloured foil is exposed while interposing a mask or a transparency through which light is shone, with the result that only the region outside opaque areas of the mask or transparency is exposed. The exposed places are then made water-soluble by developing the light-sensitive coloured layer so that they can finally be washed off or wiped away with water. A coloured pattern corresponding to the mask or the transparency is thus formed on the support foil.

If a transparent foil is used as support foil, a coloured pattern is obtained in this way which is more or less transparent corresponding to the coloured regions remaining on the foil.

The object of the invention is to broaden the range of application of light sensitive coloured foils.

In accordance with the invention, this is achieved in a coloured multilayer foil for producing a pattern for advertising purposes, comprising a coloured layer that contains a contact adhesive and after exposure to light is in part removable by washing to produce the pattern, wherein the coloured layer is enclosed between two foils having release characteristics, one foil being more readily removable than the other and one or both being transparent.

The coloured layer may be of a kind which is soluble before exposure and becomes insoluble in the areas exposed to light, or alternatively of a kind that is insoluble initially but after exposure becomes susceptible of removal. Removal of the soluble parts of the coloured layer, to leave the pattern, may precede or follow application of the coloured layer to a base, as convenient, but usually the more readily removable foil will be stripped, the soluble parts of the layer removed, and the pattern then applied to the base before the removal of the other foil.

In either case the coloured foil provides the possibility of producing a coloured pattern, stuck to a base, for example paper, by means of the contact adhesive contained in the coloured layer. The coloured layer adheres to the base and in this way a desired coloured pattern can be produced similar to the case of a print. It is also possible to stick several coloured layers on one another so that mixed colours can be produced by appropriate colour and light transparency.

The foils serve to render the coloured foil manipulatable, in particular so that it can be exposed in an apparatus without the coloured layer remaining stuck to the apparatus. If the exposure need be made through only one of the foils the light transmission of the other foil is unimportant, and this may then be conventional release paper. It may however be required that exposure of the coloured layer can be made through either foil, and then both must consist of transparent material. In each case care is taken to see that the release characteristic, i.e. adhesive-repellent effect, of the one foil is stronger than that of the other. This can be achieved in per se known manner, for example by a varying degree of siliconisation of the foils.

When using a transparent foil on both sides of the coloured layer there is the advantage that a film forming the mask can always be placed with its layer (emulsion) side directly against one of the foils. The desired reproduction in the coloured layer can thus be produced either the right way up or inverted, and as a result of the lie of the layer side of the film, a very high degree of sharpness can be obtained in the pattern to be produced.

The following procedure is adopted in order to produce a pattern stuck to a base, referring to the more readily removed foil as the 'covering' foil: a mask is placed in position, for example a series of characters or letters, line pictures or also a half-tone film, whereupon the coloured foil is exposed to light from the side of the mask. For this purpose UV light is particularly suitable, which is allowed to act for approximately 1 to 15 minutes depending on the intensity of the light source.

Instead of a mask applied in such a manner, a transparency spaced from the coloured foil can also be employed, through which the coloured foil is exposed. The covering foil is then removed, whereupon the coloured layer side of the coloured foil is, if required, coated with a developing liquid. Then the coloured layer is washed off in the region of the exposed parts or the unexposed parts according to its nature, the colour contained in the dissolved layer therefore also being removed. The coloured layer forming the pattern thus remains on the transparent foil and can be stuck to the base by means of the contact adhesive contained in the said coloured layer.

A contour-sharp, coloured, reproduction of the mask or transparency previously applied to the coloured foil and which is in fact stuck to the base, is thus obtained.

The FIGURE illustrates a sectional view of the coloured foil according to the invention. The foil consists of a transparent foil 1, a light-sensitive coloured layer 2 applied thereto, and a covering foil 3, which may be paper or a transparent covering foil, placed on top of the said layer 2. The contact adhesive used in the coloured layer can be conventional in itself, i.e. natural or synthetic resinous material, rubber or latex. Thus for example the coloured layer may be composed of a known tackifying dispersion, a colour or pigment and a further compound, which polymerises on exposure to light, particularly U.V. light, and makes the whole layer (where exposed) insoluble to solvents. Polyvinyl alcohol (PVA) is an example of a polymerisable compound, and suitable proportions for the composition are readily found by experiment. Alternatively the coloured layer may be rendered potentially soluble by exposure to light and be composed of the contact adhesive or tackifier, a basic colour or pigment and a light sensitive compound, for example a naphthoquinone diazide. Such basic colours and o-naphthoquinones are disclosed for example in German Pat. Nos. 1,291,197 and 865,860, Swiss Pat. No. 474,580 and U.S. Pat. Nos. 3,046,120 and 3,326,682, and generally the exposure of such compositions, their development, and the removal of material in the exposed areas is known in itself.

Examples of foils are conventional release papers, siliconised to give required release characteristics. Polymeric materials for example polyethylene and, specifically for transparent foils, polyesters such as polyethylene terephthalate may also be used, with release coatings as required.

I claim:

1. A colored multilayered structure for producing a pattern comprising:

(a) a light sensitive colored layer comprising a contact adhesive, a coloring agent, and a light sensitive compound; said colored layer exhibiting upon exposure to light a change with respect to a given solvent from soluble to insoluble in exposed areas but remaining soluble in the same solvent in unexposed areas, the soluble unexposed areas being removable after exposure by washing with said solvent;

(b) a first foil disposed on one surface of said colored layer; and (c) a second foil disposed on the other surface of said colored layer;

said first and second foils having release characteristics and one of said foils being more readily removable from said colored layer than the other of said foils; at least one of said foils being transparent.

2. A colored multilayered structure for producing a pattern comprising:

(a) a light sensitive colored layer comprising a contact adhesive, a coloring agent, and a light sensitive compound; said colored layer exhibiting upon exposure to light a change with respect to a given solvent from insoluble to soluble in exposed areas but remaining insoluble in the same solvent in unexposed areas, the soluble exposed areas being removable after exposure by washing with said solvent;

(b) a first foil disposed on one surface of said colored layer; and (c) a second foil disposed on the other surface of said colored layer;

said first and second foils having release characteristics and one of said foils being more readily removable from said colored layer than the other of said foils; at least one of said foils being transparent.

3. The colored multilayered structure of claim 2 wherein said solvent is a developing liquid.

* * * * *